US006131492A

United States Patent [19]

Mai

[11] Patent Number: 6,131,492

[45] Date of Patent: Oct. 17, 2000

[54] FIXED WRENCH

[76] Inventor: Hsiao-Feng Mai, No. 17, Chuan Yuan Street, Taichung, Taiwan

[21] Appl. No.: 09/305,025

[22] Filed: May 4, 1999

[51] Int. Cl.[7] ..... B25B 13/02

[52] U.S. Cl. ..... 81/119

[58] Field of Search ..... 81/119, 120, 121.1, 81/186

[56] References Cited

U.S. PATENT DOCUMENTS

| | | | |
|---|---|---|---|
| 1,624,508 | 4/1927 | Reilly | 81/186 |
| 3,242,775 | 3/1966 | Hinkle | 81/119 |
| 3,252,359 | 5/1966 | Bodkin | 81/119 |
| 3,931,749 | 1/1976 | Evans | 81/119 |
| 5,131,312 | 7/1992 | Macor | 81/119 |
| 5,313,860 | 5/1994 | Liou | 81/437 |
| 5,582,083 | 12/1996 | Baker | 81/119 |

FOREIGN PATENT DOCUMENTS

| | | | |
|---|---|---|---|
| 1957352 | 5/1970 | Germany | 81/119 |
| 99812 | 6/1923 | Switzerland | 81/119 |
| 478 | of 1872 | United Kingdom | 81/119 |
| 1242861 | 8/1971 | United Kingdom | 81/119 |

*Primary Examiner*—Stephen F. Gerrity
*Assistant Examiner*—David B. Thomas
*Attorney, Agent, or Firm*—Browdy and Neimark

[57] ABSTRACT

A fixed wrench has a handle, and an open end located at one end of the handle and formed of a left jaw and a right jaw. The left jaw and the right jaw are provided respectively with a first actuating surface and a second actuating surface. A first holding portion for holding a first fastening piece is formed by the first actuating surfaces of the left jaw and the right jaw. A second holding portion is formed by the second actuating surfaces of the left jaw and the right jaw for holding a second fastening piece different in size from the first fastening piece.

2 Claims, 3 Drawing Sheets

FIXED WRENCH

FIELD OF THE INVENTION

The present invention relates generally to a wrench (spanner), and more particularly to a fixed wrench which is used for holding and turning nuts and bolts of two specifications.

BACKGROUND OF THE INVENTION

The conventional fixed wrench is generally composed of a handle and an open end which is located at one end of the handle and provided with two jaws for holding and turning a fastening piece of a specified specification. Such a conventional fixed wrench can not be therefore used in turning the fastening pieces of other specifications.

A prior art fixed wrench is capable of turning two fastening pieces which are slightly different in size due to the fact that the sizes of these two fastening pieces are measured respectively by the English system and the metric system. Such a fixed wrench is limited in its use.

Another prior art fixed wrench has a box end which is provided with a corrugated engagement slot for turning the fastening pieces of various sizes. However, the fastening pieces can not be easily turned by a wrenching movement of the fixed wrench due to the small contact area of the engagement slot. As a result, the fastening pieces are often vulnerable to damage caused by an ineffective wrenching movement of the fixed wrench.

SUMMARY OF THE INVENTION

The primary objective of the present invention is therefore to provide a fixed wrench free from the drawbacks of the prior art fixed wrenches described above, and capable of turning the fastening pieces of two different specifications.

In keeping with the principle of the present invention, the foregoing objective of the present invention is attained by a fixed wrench comprising a handle and an open end which is located at one end of the handle and is formed of a left jaw and a right jaw. These two jaws are provided with a first actuating surface and a second actuating surface opposite to the first actuating surface. A space formed between the first and the second actuating surfaces is provided with two holding portions different in size for holding and turning the fastening pieces of two different specifications.

The foregoing objective, features, functions, and advantages of the present invention will be more readily understood upon a thoughtful deliberation of the following detailed description of the embodiments of the present invention with reference to the accompanying drawings.

DETAILED DESCRIPTION OF THE INVENTION

Figure 1:
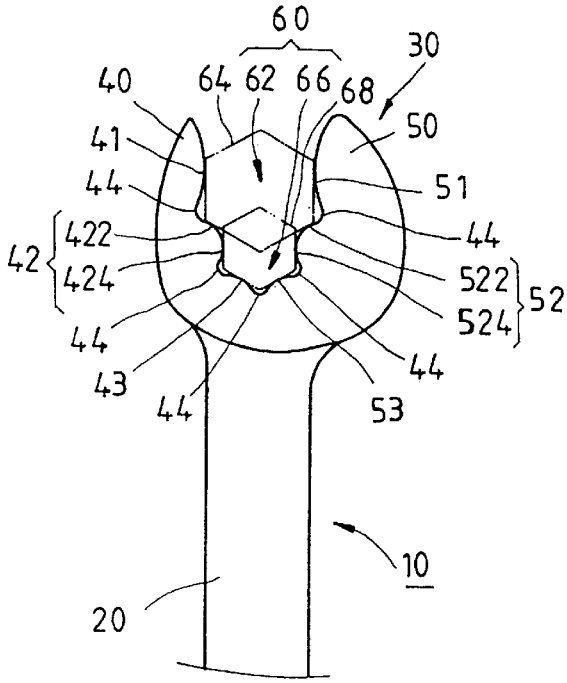
FIG. 1 shows a schematic plan view of a first preferred embodiment of the present invention.

As shown in FIG. 1, a fixed wrench 10 of the first preferred embodiment of the present invention comprises a handle 20, and an open end 30 which is located at one end of the handle 20 and is composed of a left jaw 40, a right jaw 50, and a holding space 60 formed between the left jaw 40 and the right jaw 50.

The left jaw 40 and the right jaw 50 are provided respectively with a first actuating surface 41, 51; a second actuating surface 42, 52; and a third actuating surface 43, 53. The actuating surfaces are of an arcuate construction. The second actuating surface 42(52) is provided with a front arcuate portion 422(522) and a rear arcuate portion 424 (524). Located between the two adjoining actuating surfaces of the left jaw 40 and the right jaw 50 is an arcuate depression 44.

A first holding portion 62 is formed between the two front arcuate portions 422 and 522 in conjunction with the first actuating surfaces 41 and 51 for holding a first fastening piece 64 of a size. The first fastening piece 64 is turned by a wrenching movement of the fixed wrench 10. A second holding portion 66 is formed between the rear arcuate portions 424 and 524 in conjunction with the third actuating surfaces 43 and 53 for holding a second fastening piece 68 of a size smaller than that of the fastening piece 64. The second fastening piece 68 is turned by a wrenching movement of the fixed wrench 10. The depressions 44 serve to accommodate the angled corners of the fastening pieces 64 and 68.

Figure 2:
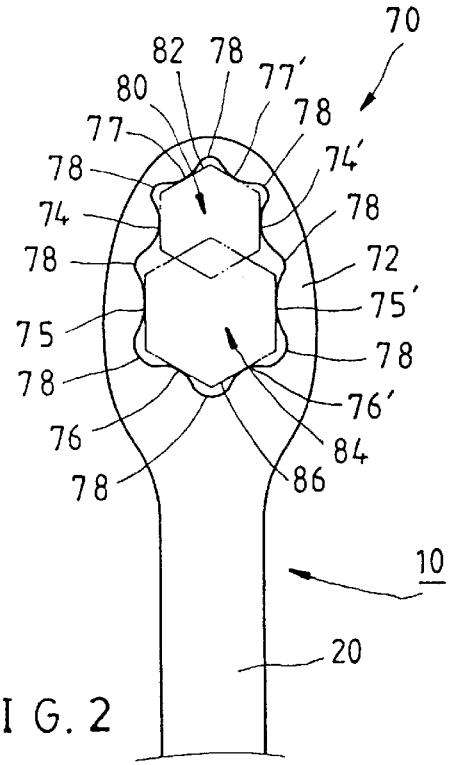
FIG. 2 shows a schematic plan view of a second preferred embodiment of the present invention.

Now referring to FIG. 2, a fixed wrench 10 of the second preferred embodiment of the present invention is shown to comprise a handle 20, and a box end 70 located at one end of the handle 20 and having a web area 72. The web area 72 is provided along the inner side thereof with four pairs of actuating surfaces, which include a first pair of actuating surfaces 74 and 74', a second pair of actuating surfaces 75 and 75', a third pair of actuating surfaces 76 and 76', and a fourth pair of actuating surfaces 77 and 77'. Located between the two adjoining actuating surfaces is an arcuate depression 78. The actuating surfaces are of an arcuate construction.

A first holding portion 80 is formed by the first pair of actuating surfaces 74 and 74' in conjunction with the fourth pair of actuating surfaces 77 and 77' for holding a first fastening piece 82 of a size. The first fastening piece 82 is turned by a wrenching motion of the fixed wrench 10. A second holding portion 84 is formed by the second pair of actuating surfaces 75 and 75' in conjunction with the third pair of actuating surfaces 76 and 76' for holding a second fastening piece 86 of a size greater than that of the first fastening piece 82. The second fastening piece 86 is turned by a wrenching movement of the fixed wrench 10. The depressions 78 are intended to accommodate the angled corners of the fastening pieces 82 and 86.

Figure 3:
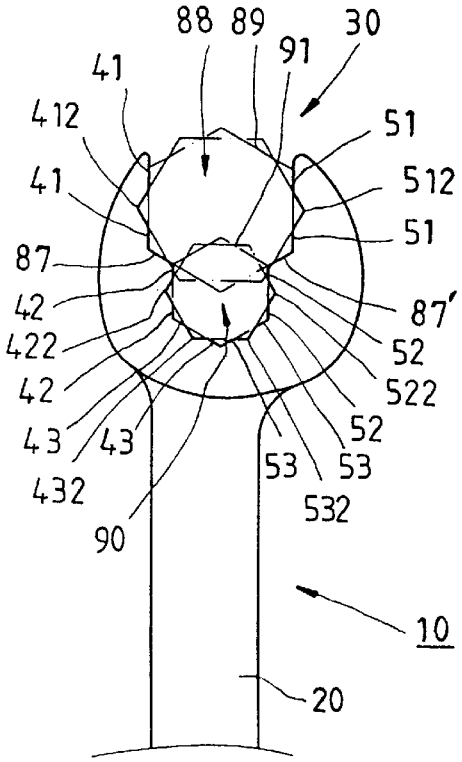
FIG. 3 shows a schematic plan view of a third preferred embodiment of the present invention.

As shown in FIG. 3, a fixed wrench 10 of the third preferred embodiment of the present invention is different from that of the first preferred embodiment of the present invention in that the former comprises a plurality of actuating surfaces 41, 42, 43, 51, 52, and 53, which are of a planar construction instead of the arcuate construction and are provided respectively in the center thereof with a V-shaped fitting face 412, 422, 432, 512, 522, 532. The V-shaped fitting face has an angle of 120 degrees. There is no depression located between the two adjoining actuating surfaces. However, there are a pair of auxiliary surfaces 87 and 87' located between the first actuating surface 41 and the second actuating surface 42. A first holding portion 88 is formed jointly by the first actuating surfaces 41 and 51, the fitting faces 412 and 512, and the auxiliary surfaces 87 and 87', for holding a first fastening piece 89 of a size. The first fastening piece 89 is turned by a wrenching movement of the fixed wrench 10. A second holding portion 90 is formed jointly by the second actuating surfaces 42 and 52, the fitting faces 422 and 522, the third actuating surfaces 43 and 53, and the fitting faces 432 and 532, for holding a second fastening piece 91 of a size smaller than that of the first fastening piece 89. The second fastening piece 91 is turned by a wrenching movement of the fixed wrench 10. The fixed wrench 10 of the third preferred embodiment of the present invention is provided with 12 choices of relative angles between the wrench and the fastening piece.

Figure 4:
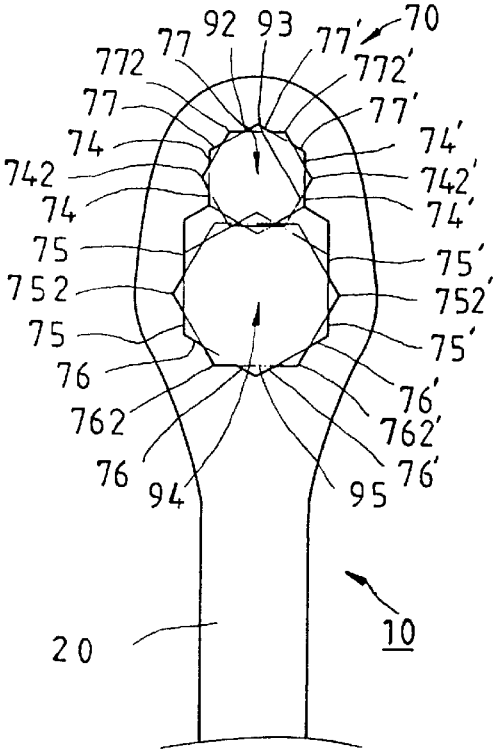
FIG. 4 shows a schematic plan view of a fourth preferred embodiment of the present invention.

As shown in FIG. 4, a fixed wrench 10 of the fourth preferred embodiment of the present invention is different from that of the second preferred embodiment of the present invention in that the former comprises the actuating surfaces 74, 74', 75, 75', 76, 76', 77, and 77', which are of a planar construction instead of the arcuate construction and are provided respectively in the center thereof with a V-shaped fitting face 742, 742', 752, 752', 762, 762', 772, 772'. The V-shaped fitting face has an angle of 120 degrees. There is no depression between the two adjoining actuating surfaces of the fourth preferred embodiment of the present invention. A first holding portion 92 is formed by the first actuating surfaces 74, 74', 77, 77', the fitting faces 742, 742', 772, and 772' for holding a first fastening piece 93 of a size. The first fastening piece 93 is turned by a wrenching movement of the fixed wrench 10 of the fourth preferred embodiment of the present invention. A second holding portion 94 is formed by the second actuating surfaces 75, 75', the fitting faces 752 and 752', the third actuating surfaces 76 and 76', and the fitting faces 762 and 762', for holding a second fastening piece 95 of a size greater than that of the first fastening piece 93. The second fastening piece 95 is turned by a wrenching movement of the wrench. The fourth preferred embodiment has advantages which are similar to those of the third preferred embodiment of the present invention.

Figure 5:
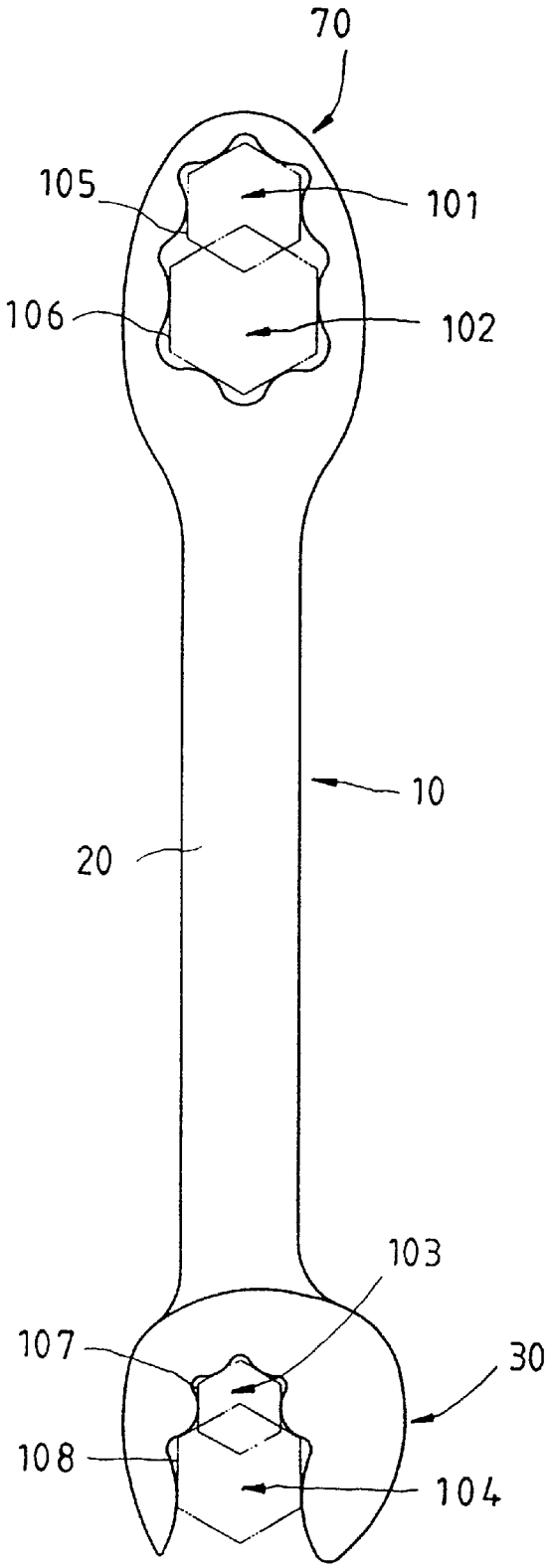
FIG. 5 shows a schematic plan view of a fifth preferred embodiment of the present invention.

As shown in FIG. 5, a combination wrench 10 of the fifth preferred embodiment of the present invention comprises a handle 20, a box end 70 located at one end of the handle 20, and an open end 30 located at other end of the handle 20. The box end 70 is provided with two holding portions 101 and 102, which are different in size for holding the fastening pieces of different sizes. Similarly, the open end 30 is provided with two holding portions 103 and 104, which are intended to hold the fastening pieces of different sizes.

The wrenches of the present invention were tested for their structural strength. The test results show that the wrenches of the present invention are structurally strong and sustainable under the circumstance of normal use thereof.

What is claimed is:

1. A fixed wrench comprising:

a handle;

one end of the handle formed with a left jaw, and a right jaw;

wherein said left jaw is provided with a first actuating surface and a second actuating surface; and said right jaw is provided with a first actuating surface and a second actuating surface; wherein, a first holding portion of a size is formed by said first actuating surfaces of said left jaw and said right jaw, and a second holding portion which is different in size from said first holding portion and formed by said second actuating surfaces of said left jaw and said right jaw, wherein said right jaw has an end which is joined with an end of said left jaw to form a closed space containing said first holding portion and said second holding portion;

wherein said first holding portion is further provided with two fourth actuating surfaces adjacent to said first actuating surfaces; and wherein said second holding portion is further provided with two third actuating surfaces adjacent to said second actuating surfaces, and wherein each of said actuating surfaces is provided with an arcuate surface.

2. The fixed wrench as defined in claim 1, wherein said first holding portion and said second holding portion are provided with a plurality of depressions each being located between two adjoining actuating surfaces.

* * * * *